US006245209B1

(12) United States Patent
Bill

(10) Patent No.: US 6,245,209 B1
(45) Date of Patent: Jun. 12, 2001

(54) ELECTRO-REFINING SYSTEM AND METHOD

(76) Inventor: Jacobs Bill, 2450 S. Camino Seco, Tucson, AZ (US) 85710

( * ) Notice: Subject to any disclaimer, the term of this patent is extended or adjusted under 35 U.S.C. 154(b) by 0 days.

(21) Appl. No.: 09/231,276

(22) Filed: Jan. 15, 1999

(51) Int. Cl.[7] ..... C25C 1/00; C25C 5/00; C25D 17/00; C25B 15/00; C25B 11/00

(52) U.S. Cl. ..... 205/350; 204/227; 204/230.3; 204/269; 204/274; 204/280; 204/281; 204/286.1

(58) Field of Search ..... 205/350, 114; 204/227, 241, 281, 274, 288–289, 288.6, 230.3, 226, 269, 280

(56) References Cited

U.S. PATENT DOCUMENTS 3,256,172 * 6/1966 Dörfel et al. ..... 204/279 X
4,152,238 * 5/1979 Okazaki ..... 204/241 X
5,266,176 * 11/1993 Muret et al. ..... 204/274 X
5,290,412 * 3/1994 Saito et al. ..... 204/281 X
5,785,827 * 7/1998 Dougherty ..... 204/281 X
6,017,429 * 1/2000 Persson ..... 204/281

* cited by examiner

*Primary Examiner*—Donald R. Valentine
(74) *Attorney, Agent, or Firm*—Mark E. Ogram

(57) ABSTRACT

An electro-refining system in which the deposited metal is harvested without the need to remove the cathode from the slurry bath. The cathode has a hollow cavity permitting steam or hot water to be introduced to heat the cathode. During the deposition process, the heating of the cathode encourages the deposition process. When the deposited material is to be harvested, the cathode is heated to "melt" the bonds between the cathode and the deposited metal. Using a bracket which was installed before the deposition process and into which the deposited metal has been formed, the now-released sheet of deposited metal is easily removed.

14 Claims, 13 Drawing Sheets

ELECTRO-REFINING SYSTEM AND METHOD

BACKGROUND OF THE INVENTION:

This invention relates to refining of ores and more particularly to electro-refining systems and methods.

In electro-refining, semi pure copper anodes are suspended in acid next to a cathode. The anode is given a positive charge of direct current while the cathode is given a negative charge. This charge causes the copper ions to transfer from the anode to the cathode and the impurities fill to the bottom of the tank.

In solvent Extraction-Electro-winning (SXEW) the copper is leached out of the ore, the leachate is concentrated and pumped into tanks similar to electro-refining. The difference is in Electro-winning the copper enters the tank in liquid solution, The anode is not impure copper, it is permanent and usually lead. The direct current voltage between the anode and cathode is greater in Electro-winning than in electro-refining because the dissolving of the impure copper in acid generates some voltage.

In either case the cathode can be permanent, usually stainless steel or titanium, or a starter sheet. The starter sheet consists of a one day deposit of copper suspended from a metal bar, usually copper and immersed in the tank. Copper is deposited on all surfaces of the starter sheet and this copper along with the starter sheet is harvested every 7 to 14 days at a weight of 240 to 400 pounds.

The direct current flowing thru each cathode is quite high, from 350 to 700 amps. Each tank or cell can have from 35 to 60 Cathodes.

As the temperature of the surface of the cathode is increased the rate and quality of copper deposition is increased. Currently all of the electrolyte flowing tbru the cell is heated to keep the surface of the cathode warml When the electrolyte gets too hot the permanent lead anode is degraded and more acid vapors at evolved and enter the atmosphere of the cell house.

In the case of a permanent cathode of stainless steel of titanium, care must be taken to prevent the copper from depositing around the edge and locking itself on the metal. Usually a non conducting edge strip is attached to the cathode to keep the copper off the edges. Wax is sometimes deposited on the bottom edge for the same reason. The wax process is messy and must be cleaned off and redeposited after each harvest of copper.

It is clear that there is a need for an improved electro-refining system. Another Type of metal refining cell is the "bi-polar" cell. In this type of cell the current flows sequentially throu the cell from one end to the other. One side of each metal plate is the anode and the other is the cathode. In the case of SXEW, lead or carbon is bonded to a sheet of stainless steel. A series of these plates are placed parallel to each other ina tank with groves in the sides and bottom to receive them. A direct durrent is induced at one end of the tank and flows from panel to panel to the other end. The new and novel cathode in this invention can be readily adapted the perform in the bi-polar cell by bonding lead, carbon, graphite or some other nobel material on the anode of the panel.

SUMMARY OF THE INVENTION

The invention creates an electro-refining system in which the deposited metal is harvested without the need to remove the cathode from the electrolite. Since the invention allows the harvesting to be conducted without the removal of the cathode, the electro-refining process is much faster and more easily accomplished. Further, since the cathodes are not being constantly removed and inserted into the slurry bath, there is minimal chance of damaging the cathodes.

The cathode has an interiorcavity permitting steam to be introduced to heat the cathode. In the preferred embodiment, baffles are used to direct the steam flow through the cavity so that the cathode is uniformly heated.

The introduction of the steam into the cavity within the cathode is accomplished in several different ways. The preferred technique is to utilize the support brackets which contain an opening which nests onto a steam outlet. The opening in the support bracket channels the steam into the cavity.

During the deposition process, heating of the cathode encourages the deposition process. In one embodiment of the invention, the cathode is treated to two levels of heating. The first lower level is to encourage the deposition process; the second, much higher level is to assist in the removal of the deposited metals.

When the deposited material is to be harvested, the steam raises the temperature of the cathode above the boiling point of water. At this stage, moisture trapped between the deposited metal and the cathode vaporize, expand, and break the bond between the deposited metal and the cathode.

Using a lifting bracket which was installed before the deposition process and into which the deposited metal has been formed, the now-released sheet of deposited metal is easily removed. The bracket/deposited metal is removed from the electrolyte without the need to remove the cathode. A new bracket is then placed over the cathode and the deposition process is begun anew.

This invention deals with:

A. A different way to prevent the copper from depositing around the edge of a cathode;

B. An improved method to separate the copper from the cathode at harvest; and

C. An improved method to increase the surface temperature of the cathode.

An improved cathode for electro-refining or electro-winning is created in which two thin stainless steel or titanium sheets, 0.024 to 0.0157 inches thick, are resistance welded to each other on 1½ to 4 inch centers. This sandwich is then resistance, seam welded all around the outside edge to form an air tight assembly. This assembly is then inflated between two fixture plates that allow the thin surface sheets to expand to the width between the fixtures. This stretching of the metal flattens the assembly and forms a hollow chamber. The thin sheets can also be formed before welding to eliminate the inflation step.

The welded and inflated assembly is attached to two solid copper hanger bars/bracket and a non-conducting material is inserted between the two thin sheets into the grove that extends all around the outside edge. The non-conducting material can be a hot melt adhesive, a castable ceramic, a filled reactive resin like vinyl ester, or solid plastic strips that are staked in place. Two non conducting panels of fiberglass reinforced plastic or formed thermoplastic, with vertical grooves separated by interval between the cathodes can be attached on each side of a group of cathodes to prevent the metal from depositing around the edge. These panels can also be reinforced with plastic pipe that is drilled in such a way to allow for the introduction of fresh electrolyte between each anode/cathode pair. Not only do these panels prevent the deposition of metal around the edge that impedes harvest but they also hold the anodes and cathodes at more preciseintervals then ever before.

While the cathode is immersed in the cell and copper is being deposited, very hot water from 120* F to 200* F is circulated inside the electro-deposition plate. This hot water heats the surface where the copper is being deposited and improves the process.

In one embodiment, when the cathode is ready for harvest it is removed from the cell and transported to a stripping device. Here the hot water is replaced 20 to 60 psig steam that rapidly heats the cathode and flashes the moisture in a coating on the surface of the cathode between the newly deposited copper and the stainless or titanium. The flashed steam exerts a 20 to 60 psig force to strip the copper of the cathode.

The cathode, when in the electro-deposition process, is subjected to a high current flow. The direct current flowing through each cathode is quite high, from 250 to 600 amps. Each tank or cell has 45 to 60 cathodes or more. This means that the combined current through each cell can be as high as 36,000 amps.

If a short forms between a cathode and an anode, the entire current flow will try to flow through one cathode causing massive damage to the cathode and potentially to the entire system.

In the preferred embodiment, a "fusable link" is placed between the electrical buss and the support for the cathode or anode. Electrical current is communicated to the cathode or anode only through the fuse block. Should a short form, the fuse block (due to its material composition) melts, allowing the cathode to "settle" onto an electrically isolated support; thereby, terminating the electrical flow through the cathode so that damage due to the short is prevented.

Within the present invention, the cathodes are connected to the buss bar providing the electrical flow via a fuse. The fuse is able to conduct the desired electrical flow, but, as the electrical flow exceeds an acceptable safe range, the fuse disconnects the electrical flow to protect the cathode.

If a cathode or anode shorts out more than 50,000 amps can flow through it causing a melt down. The preferred fuse of this invention melts and disconnects the shorted device from the power supply.

The fuse action, in one embodiment of the invention, is created by supporting the cathode on a metal slug which acts as the fuse. When the electrical flow exceeds the safe limits (preferably less than 1500 amps), the metal slug melts and the connection between the buss bar/slug/cathode is broken. In this manner, the cathode is protected from damage caused by over heating.

The breakage of the connection is caused by changes in the metal slug. As the metal slug heats due to excess current flow, it softens, allowing the cathode bar to drop until the cathode rests on the insulating cap block. At this point the contact pressure between the cathode bar and the metal slug drops, creating a higher resistance between the two, thereby creating even more heating. This additional heating results in an accelerated melting of the metal slug and a complete loss of electrical conductivity.

In the preferred embodiment, the melting of the metal slug allows a spring loaded flag to rotate upwards to notify the operators of the cell house that current has been interrupted to that specific cathode. When this happens, the operator identifies and corrects the short circuit within the cathode. The repaired cathode is then placed back into the cell with a replacement metal slug fuse and flag.

A wide number of alternative embodiments are available. In one such alternative embodiments, the fusible slug is installed on the anode in SXEW cell house. In the SXEW cell house, the anode is not removed for harvest every seven to ten days. The flag is then raised by the "drop" (signiing a short circuit) of either the anode or cathode as the fusible slug melts.

A wide variety of materials are available for the metal slug. Those of ordinary skill in the art readily recognize several such materials including: lead, bismuth or any combinations of alloys that melt at low temperatures such as 550 to 700 degrees Fahrenheit.

By supporting the cathode on a metal slug that will melt when the current flow exceeds 1500 amps, the cathode is protected from damage caused by over heating. As noted earlier, as the metal slug heats due to excess current flow, it softens and the cathode bar drops until it rests on the insulating cap block. At this point the contact pressure between the cathode bar and the metal slug will drop and cause even more heating. This heating will then result in a complete loss of electrical conductivity.

The invention, together with various embodiments thereof will be more fully explained by the accompanying drawings and the following descriptions.

DRAWINGS IN SUMMARY

Figure 5A:
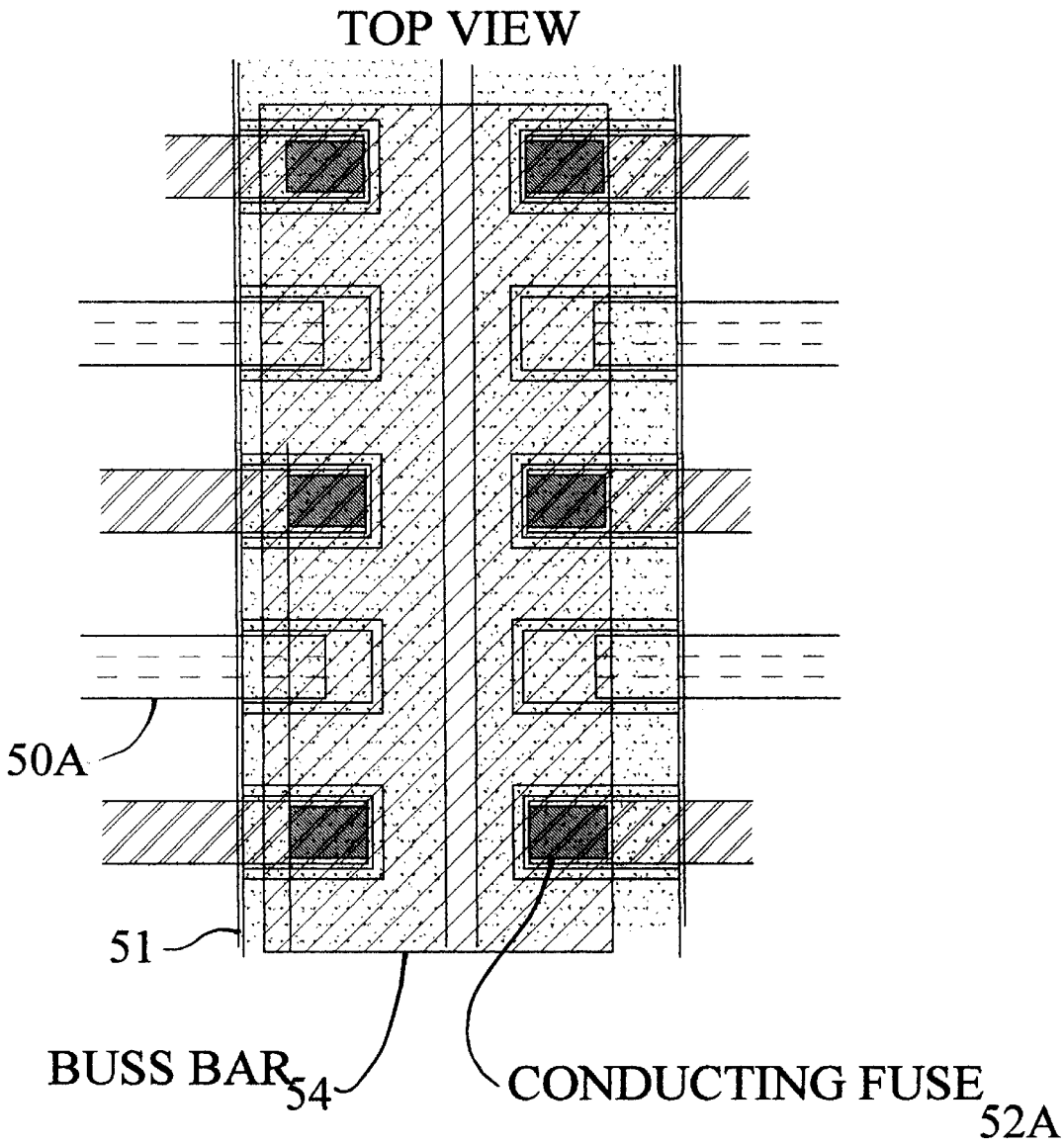
Figure 5B:
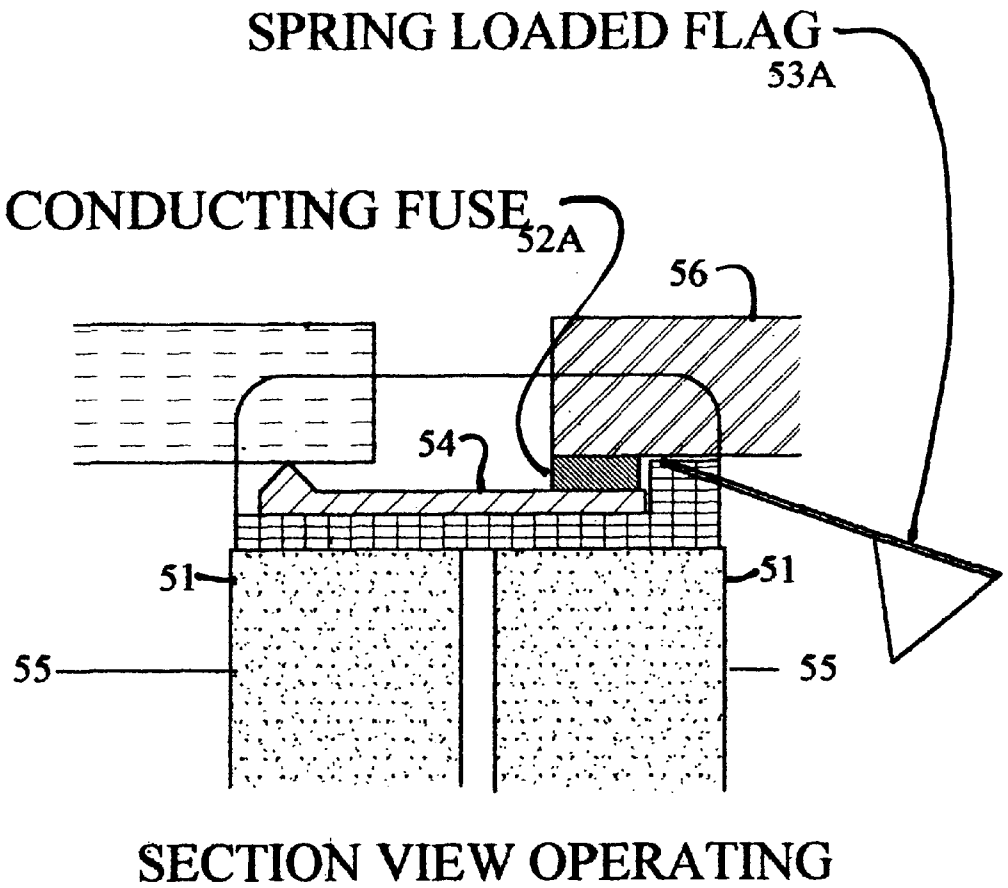
Figure 5C:
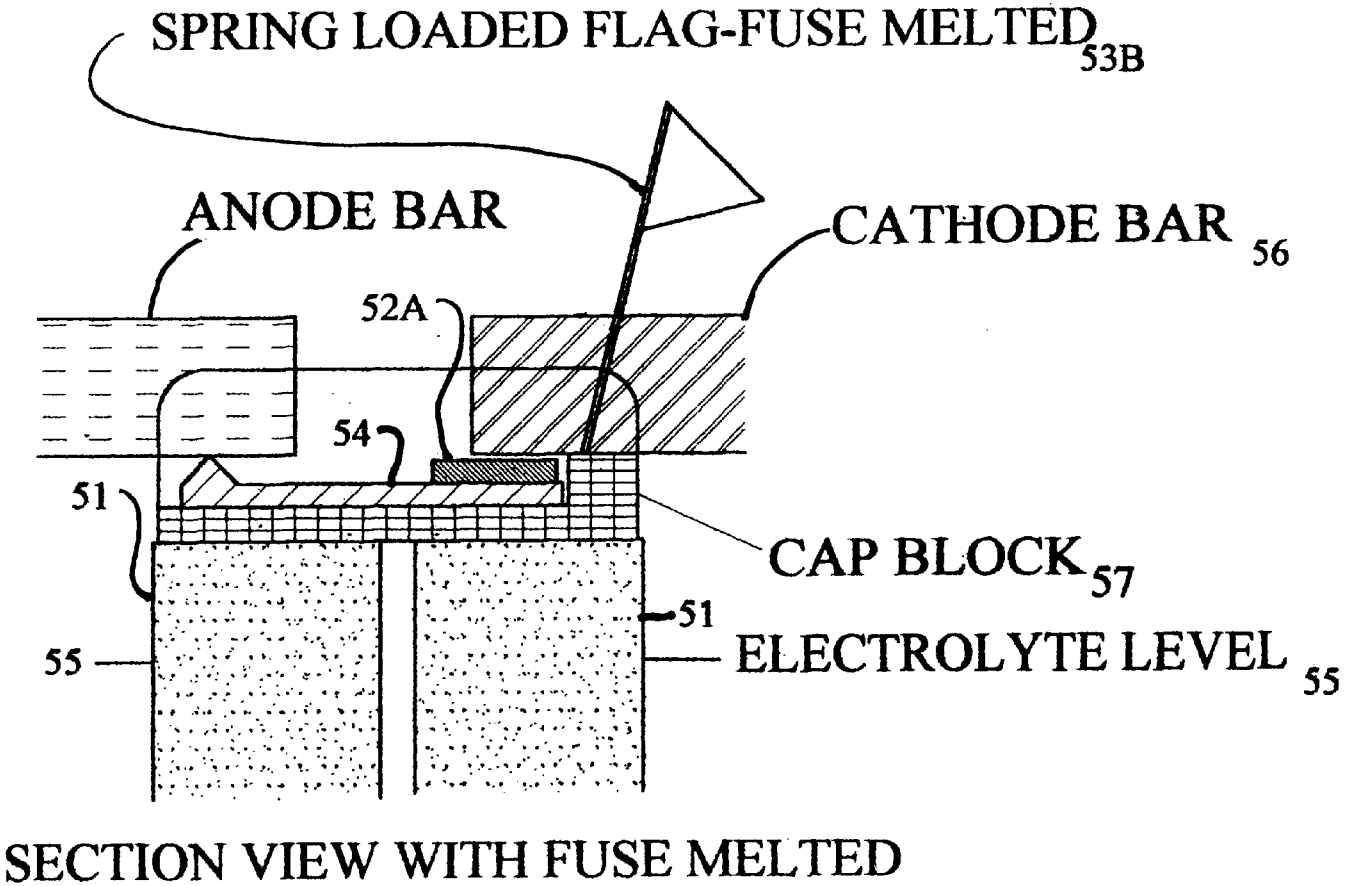

FIGS. 5A, 5B, and 5C are top and sectional views showing the fuse of this invention in operation.

Figure 6A:
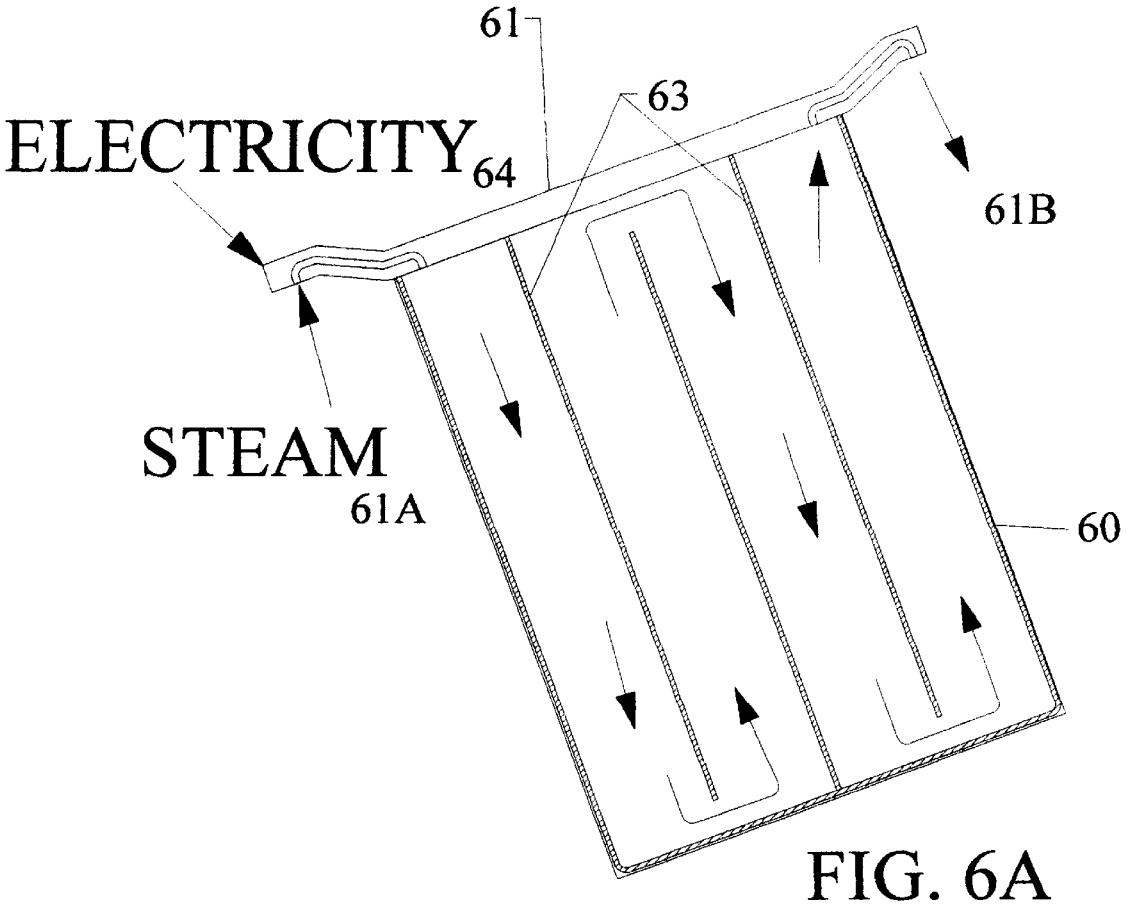

FIG. 6A is a perspective view of the preferred embodiment of the cathode.

Figure 6B:
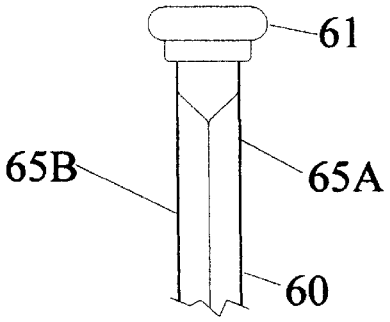

FIG. 6B is a sid e view of the preferred embodiment of the cathode.

Figure 7:
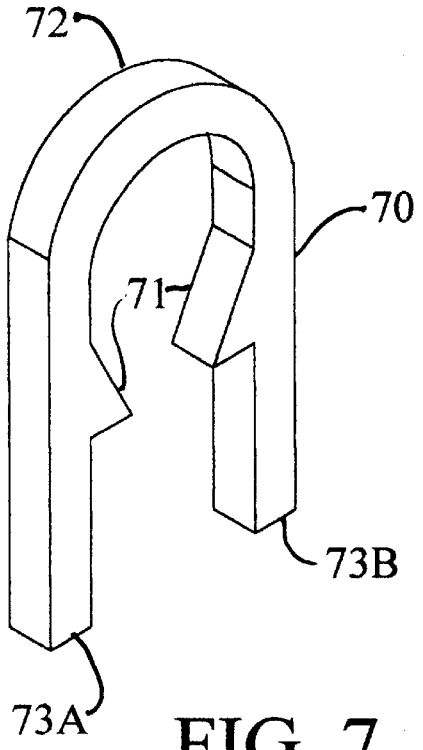

FIG. 7 is a perspective view of the preferred bracket for use in the removal of the deposited metals.

Figure 8A:
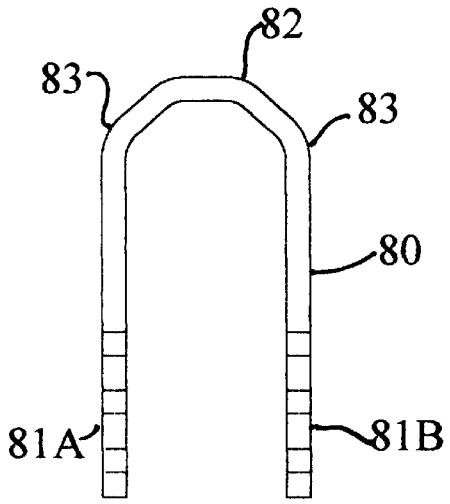
Figure 8B:
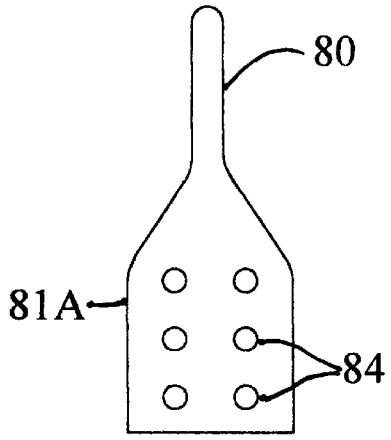

FIGS. 8A and 8B are frontal and side views of an alternative bracket used for the removal of deposited metals.

FIGS. 9A, 9B, 9C, and 9D illustrate the cathode of this invention in operation wherein the metal is deposited onto the cathode, the deposited metal is released from the cathode, and the deposited metal is removed from the slurry/bath.

Figure 10:
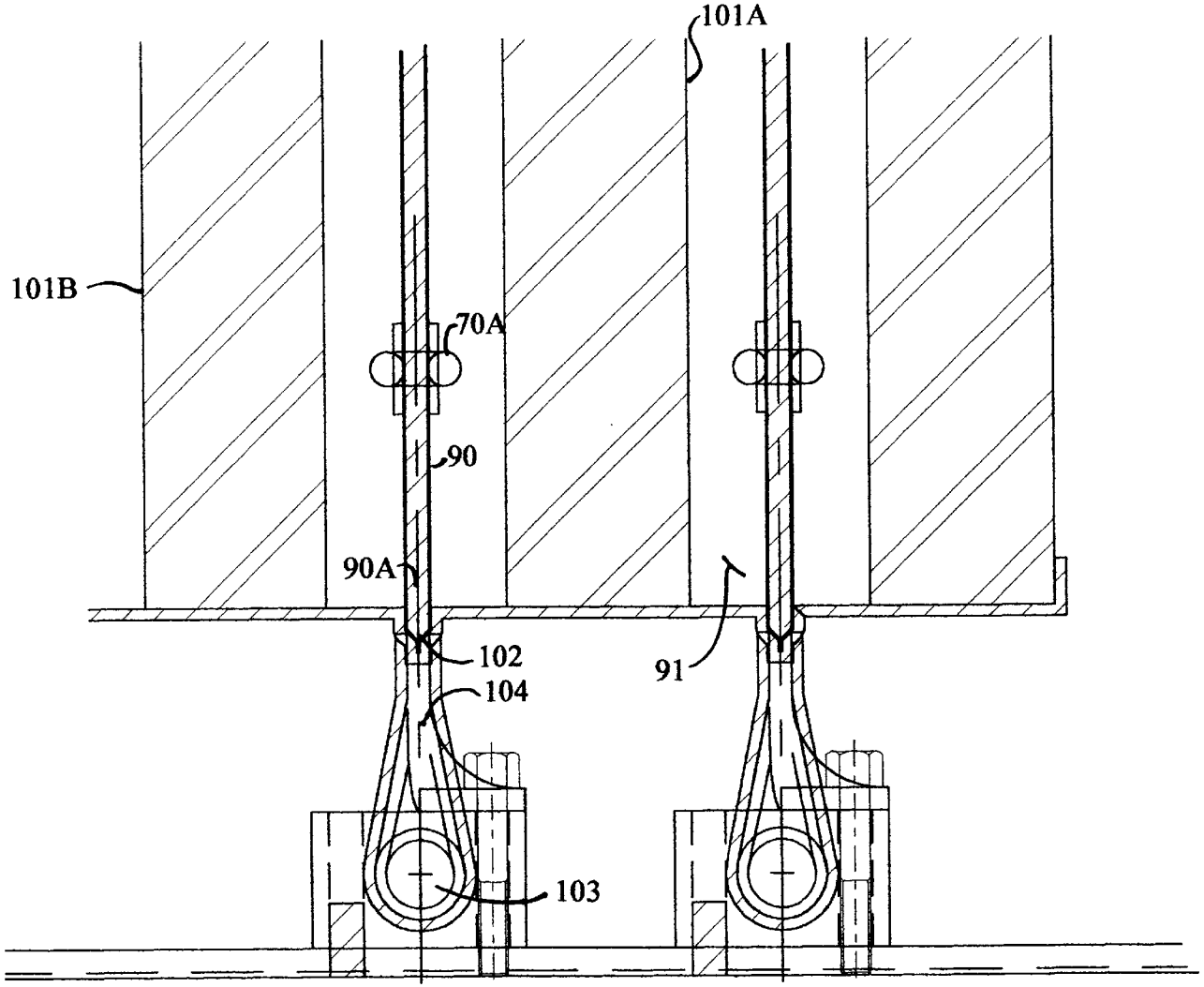

FIG. 10 is a top view which diagrams the preferred connection for the application of steam to the cathode as well as the preferred edge protector.

Figure 11A:
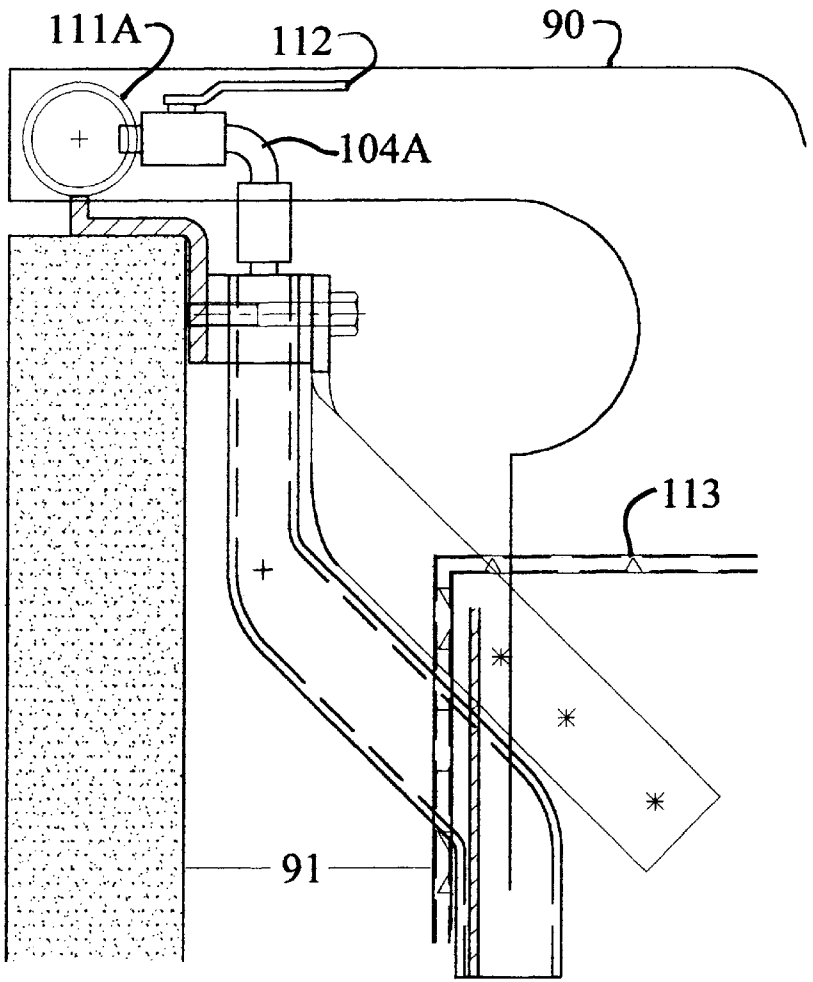
Figure 11B:
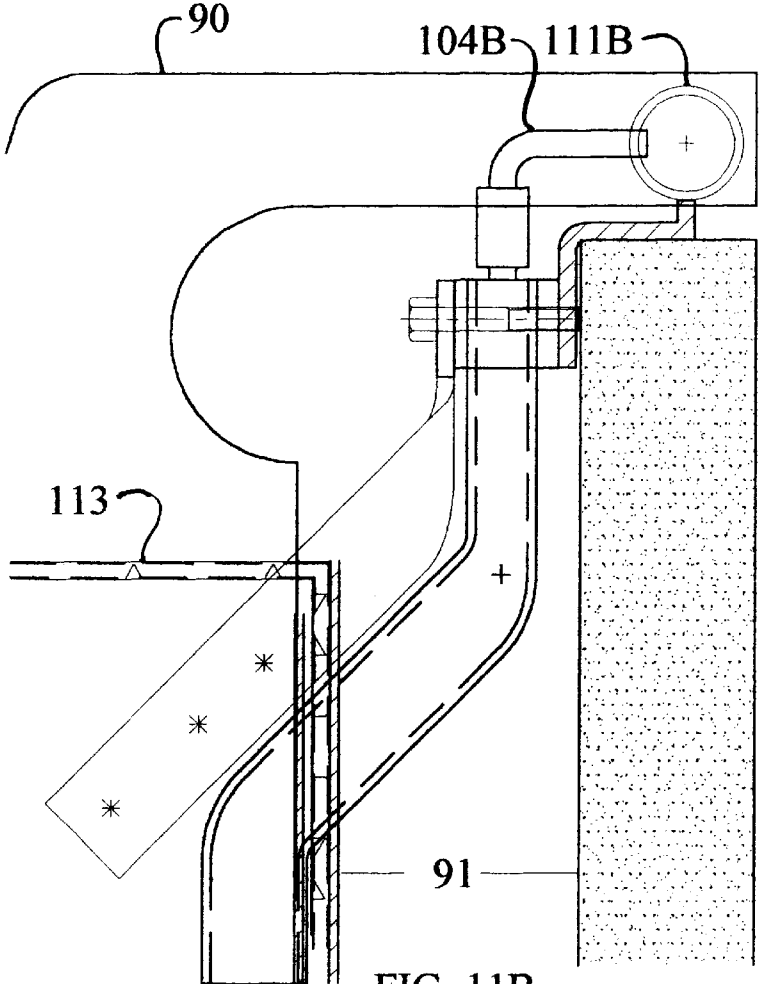

FIGS. 11A and 11B are side views of the support mechanism and steam application system of one embodiment of the invention.

Figure 12:
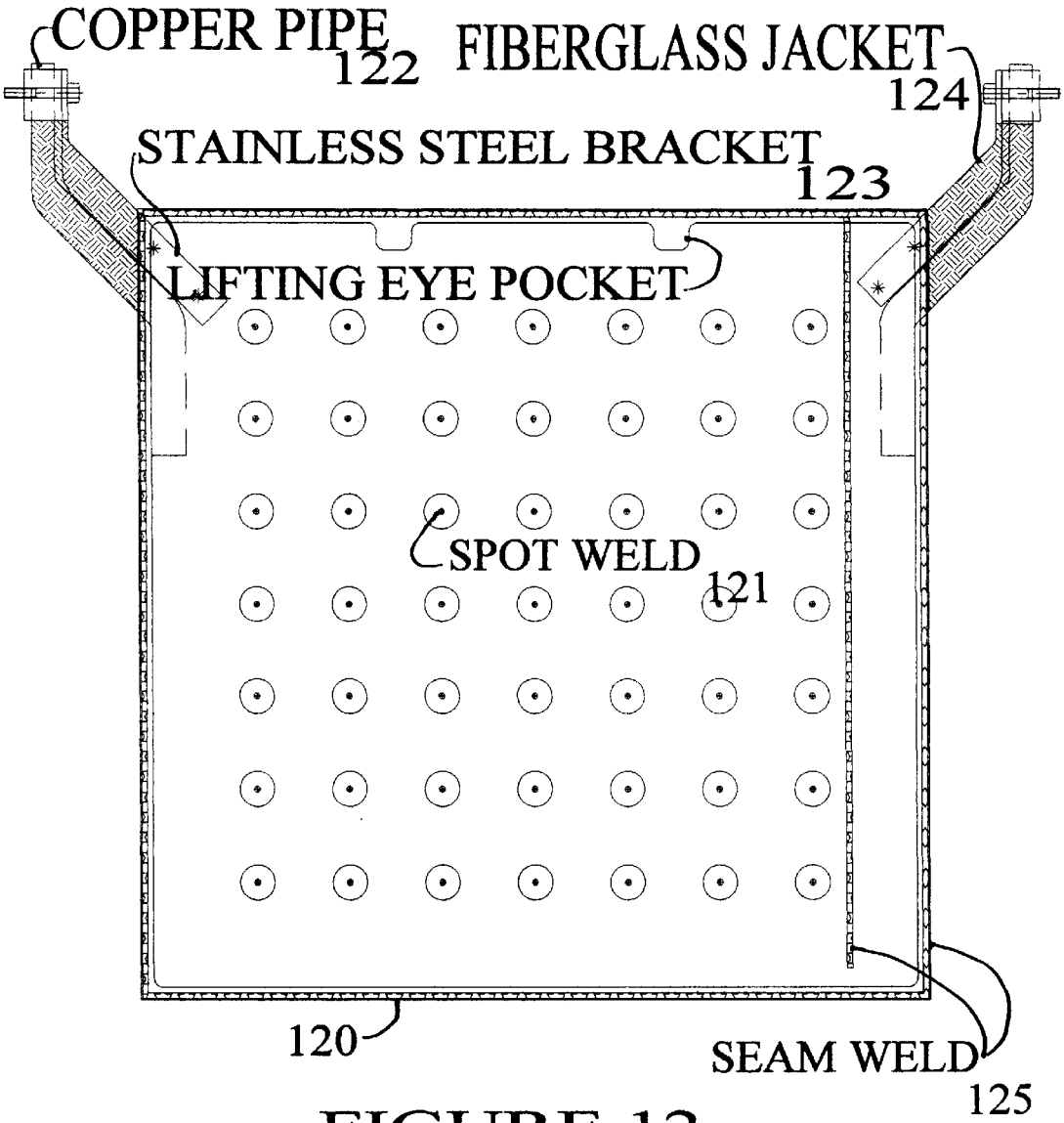

FIG. 12 is a frontal view of one embodiment of the cathode.

DRAWINGS DETAIL

Figure 1:
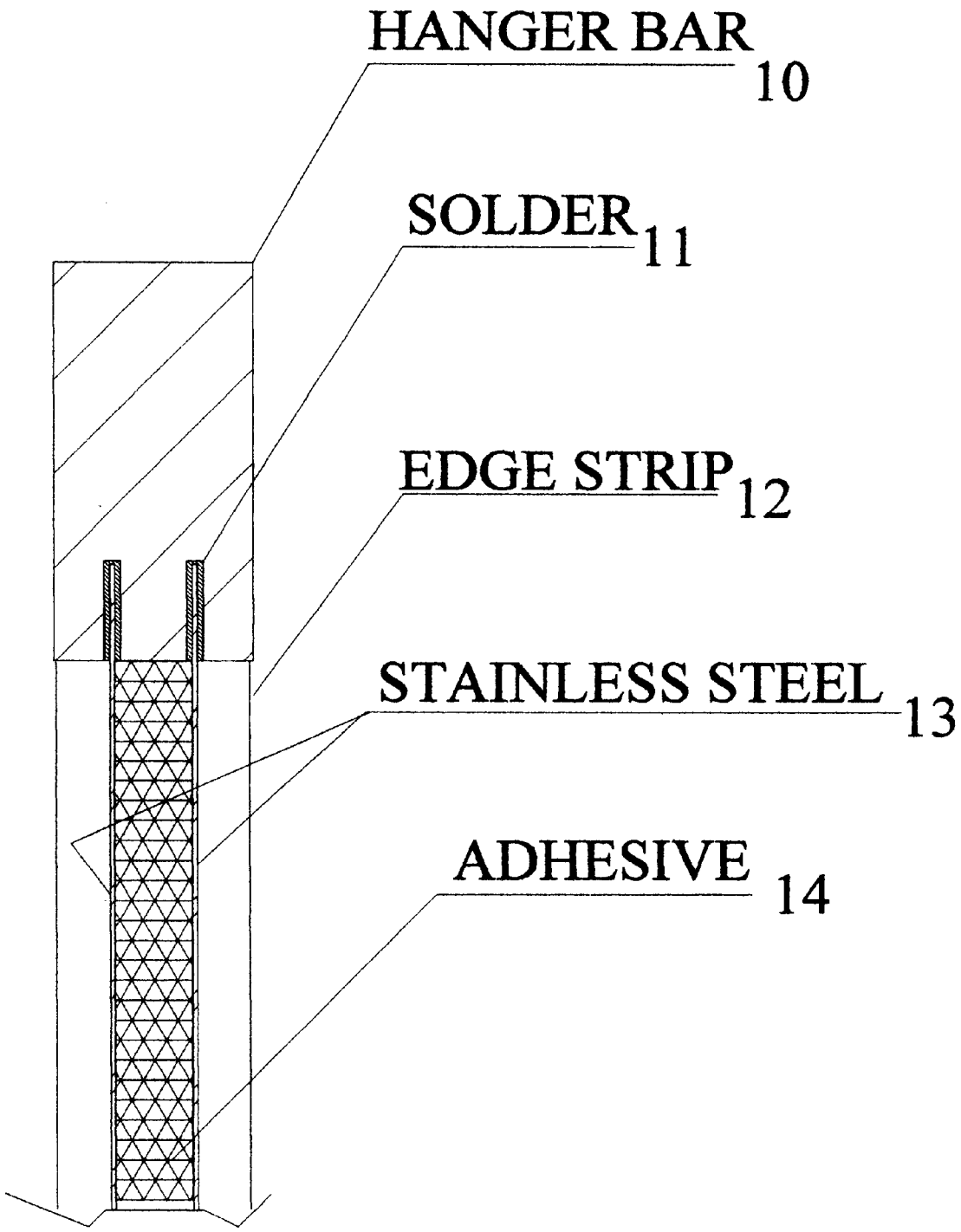
FIG. 1 is a side view of the top portion of the preferred embodiment of the cathode of this invention

FIG. 1 is a side view of the top portion of the preferred embodiment of the cathode of this invention.

In this embodiment, stainless steel sheets 13 are secured into hangar bar 10. Hangar bar 10 is used to suspend the cathode within the slurry bath, to conduct electrical current to stainless steel sheets 13, and in the preferred embodiment, to communicate steam into a cavity between stainless steel sheets 13.

Solder 11 is used between hangar bar 10 and stainless steel sheets 13 to provide proper electrical connection therebetween., Adhesive 14 is used to bind the stainless steel sheets 13 to each other. In the preferred embodiment, adhesive 14 is placed as a bead along the edge of stainless steel sheets 13 and is "woven" on the interior portion to form channels for the flow of steal Edge strip 12 is used to keep deposition from occurring along the edge of the cathode. Preventing deposition along the edge of the cathode is important as it permits the easy removal of the deposited metal as outlined below.

In an alternative embodiment of this invention, the electrode described above is constructed using a rare earth metal for the plate. When this is done, the electrode is capable of working as an anode in the same manner that the present discussion relates to cathodes.

Figure 2:
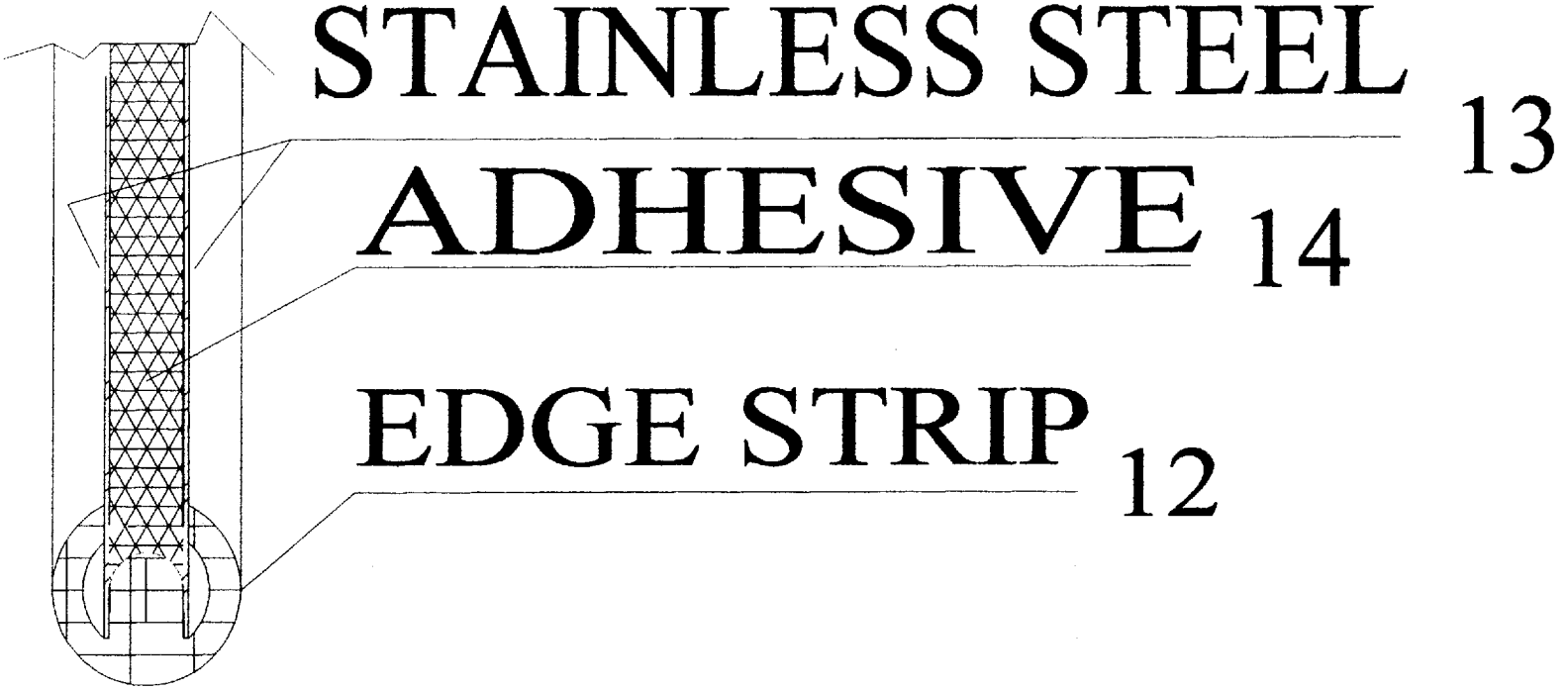
FIG. 2 is a cross view of the lower section or side of the cathode illustrating the edge strip insulator.

FIG. 2 is a cross view of the lower section of the cathode illustrating the edge strip insulator.

As with the upper portion of the cathode, two stainless steel plates 13 are separated by adhesive 14. Edge strip 12 (shown here in cross sectional view) electrically isolates the edge of the cathode to prevent electro-deposition from occurring along the edges of the cathode. Since the electro-deposition is restrained to only the planar surfaces of the cathode, thereby allowing the deposited material to be more easily removed.

Figure 3:
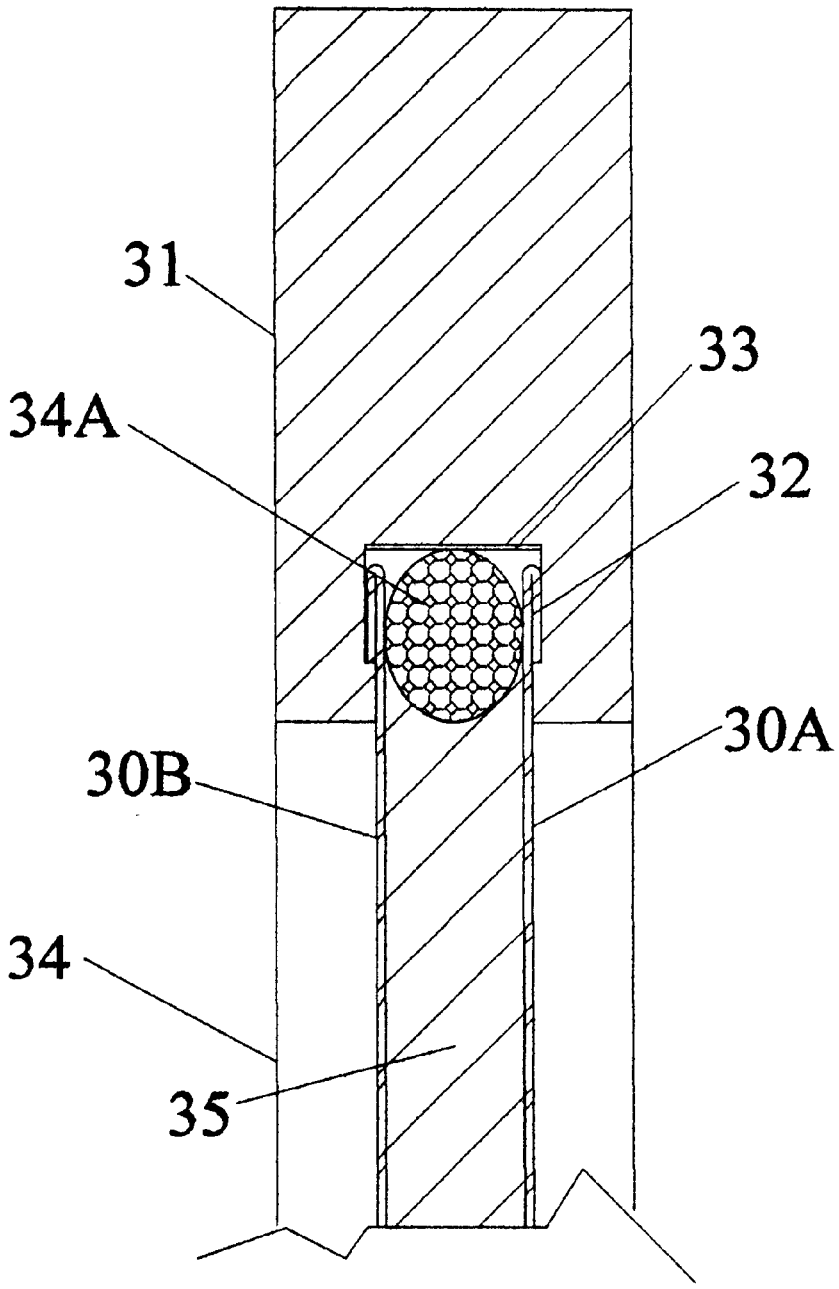
FIG. 3 is a side view showing one embodiment's connection of the electro-deposition plate to the bus bar.

FIG. 3 is a side view showing one embodiment's connection of the electro-deposition plate to the bus bar.

The electro-deposition plate 34 has outer metal sheets 30A and 30B which, in this embodiment, are bound by conductive epoxy 35. An upper end 32 of electro-deposition plate 34 is inserted into cavity 33 of bus bar 31. Securing the top of electro-deposition plate 34 is accomplished by inert 34A which expands upper end 32 to be securely engaged with bus bar 31.

In this context, conductive epoxy 35 maintains sheets 30A and 30B parallel and equidistant. Preferably, conductive epoxy 35 is an electrical conductor to enhance the distribution of current flow through the metal sheets 30A and 30B. One such conductive epoxy 35 is a plastic sheet with adhesive to bond it to the metal sheet 30A and 37.

Figure 4:
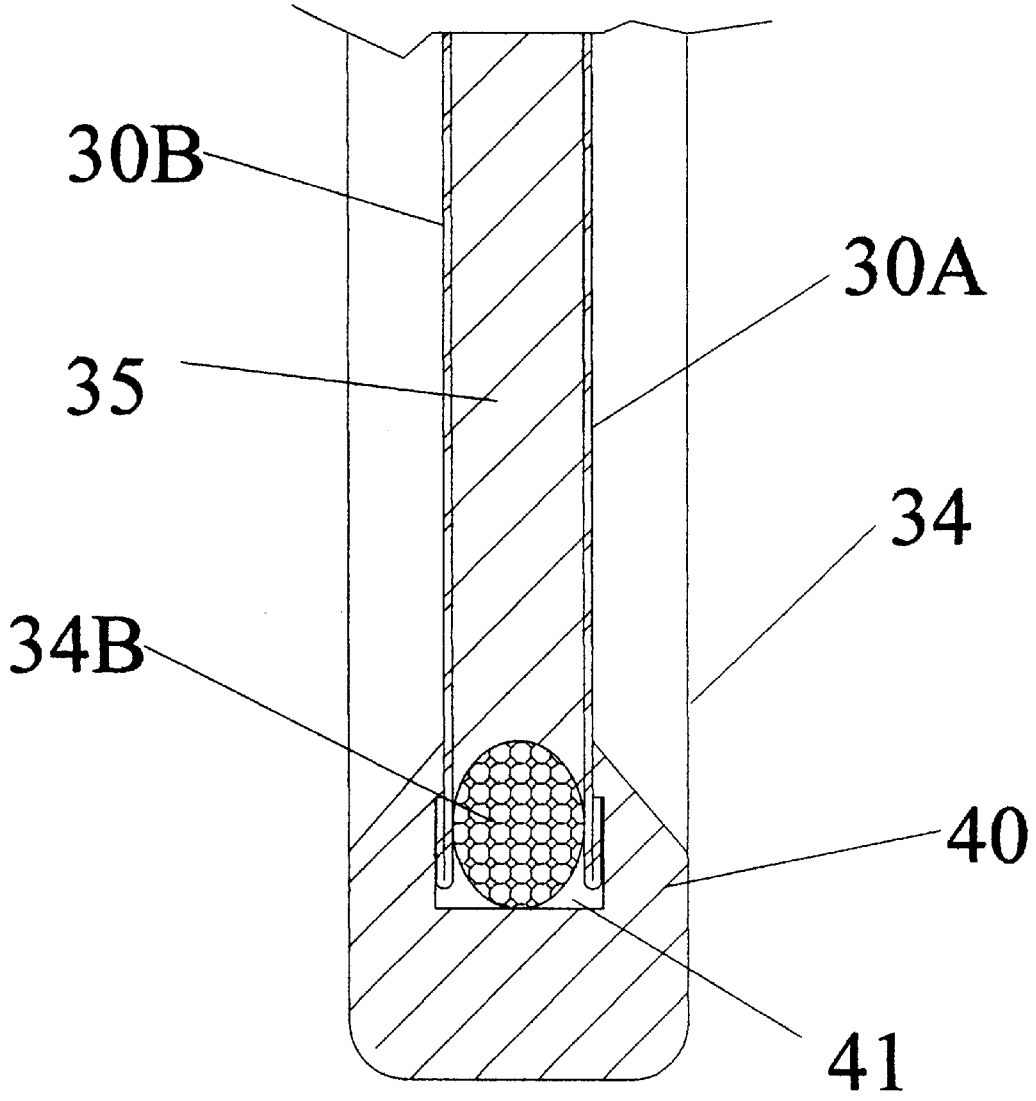
FIG. 4 illustrates the attachment of the edge protector onto the cathode first described in FIG. 3.

FIG. 4 illustrates the attachment of the edge protector onto the cathode first described in FIG. 3.

In a similar manner as to that with the bus bar (FIG. 3), the edge of the electrodeposition plate 34 is inserted into cavity 41 of insulator 40. The edge is then expanded by insert 34B to form a seal and secure fit.

Ideally, the corners of the sheets of metal 30A and 30B are trimmed to a radius greater than one inch. The plastic edge strip 40 is heated and bent around this radius so that one single edge strip covers all three edges.

FIGS. 5A, 5B, and 5C are top and sectional views showing the fuse of this invention in operation.

During normal operation (FIGS. 5A and 5B) cathodes 50A and 50B extend into the slurry bath 55. Electrical current is provided to the cathodes via buss bar 54 and conducting fuse 52A. In this condition, spring loaded flag 53A is in a "down" position. The entire assembly is supported by wall member 51.

When the current through conducting fuse 52A exceeds its maxium, the fuse "melts" (FIG. 5C). As fuse 52A melts, fuse 52A no longer supports the cathode bar which descends and is now supported by cap block 57. Also, due to the melting of fuse 52A, electrical connection between the buss bar 54 and the cathode bar 56 is broken; thereby electrically isolating cathode 50A.

To alert the operator of the "blown fuse", spring loaded flag 53B rises to identify the cathode with the exhausted fuse.

FIG. 6A is a perspective view of the preferred embodiment of the cathode.

At the top of electro-deposition plate 60 is hanger 61 which provides not only the electrical connection 64 but also the inlet 61A and outlet 61B for the communication of steam through the interior of electro-deposition plate 60.

Baffles 63 within the cavity of electro-deposition plate 60 cause the steam to travel a serpentine route to provide heat throughout the electro-deposition plate 60.

FIG. 6B is a side view of the preferred embodiment of the cathode.

Electro-deposition plate 60 is created by metal plates 65A and 65B which are held in parallel position and are adapted to be supported by hanger 61 and immersed into the slurry bath FIG. 7 is a perspective view of the preferred bracket for use in the removal of the deposited metals.

Bracket 70 is a unitary piece adapted to extend over the top of the cathode. Prongs 73A and 73B are adapted to extend along the surface of the electro-deposition plate so that as metal deposition occurs, prongs 73A and 73B are embedded in the deposited metal.

Flanges 71 are designed to properly immerse prongs 73A and 73B.

When the electro-deposition process has been completed, the deposited metal is released from the cathode and using a hoist secured to hook receiver 72, bracket 70, together with the deposited metal, is easily removed from the slurry bath.

While the present illustration describes a single bracket 70, any number of brackets can be used.

FIGS. 8A and 8B are frontal and side views of an alternative bracket used for the removal of deposited metals Bracket 80, as with bracket 70, is adapted to extend over the top of the cathode so that prongs 81A and 81B extend into the slurry bath and are embedded into the deposited metal during the electro-deposition process.

In this embodiment, prongs 81A and 81B are flattened at the end with several openings 84 formed therein. Openings 84 permit the deposited material to be formed therein, this in turn provides for an enhanced bonding between bracket 80 and the deposited metal.

Bracket 80 is shaped so that it rests on the top of the cathode at shoulders 83. Hook receiver 82 is shaped to receive a hook or chain from a hoist (not shown).

FIGS. 9A, 9B, 9C, and 9D illustrate the cathode of this invention in operation wherein the metal is deposited onto the cathode, the deposited metal is released from the cathode, and the deposited metal is removed from the slurry/bath.

Figure 9A:
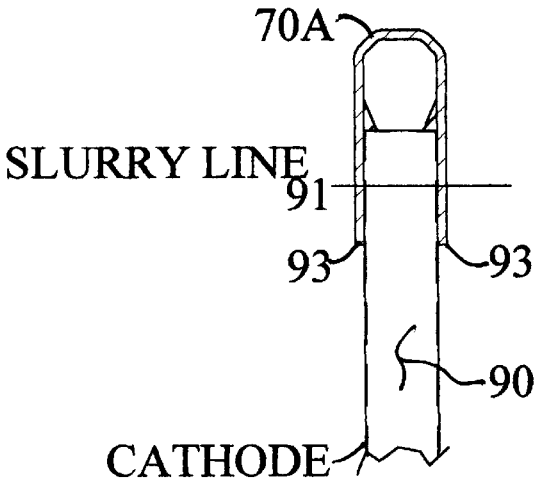

Referring to FIG. 9A, cathode 90 is partially immersed into slurry bath 91. Bracket 70A is placed over the top of cathode 90 so that ends 93 pass into the slurry bath 91. Ends 93 are positioned to be proximate to the surfaces of cathode 90.

Figure 9B:
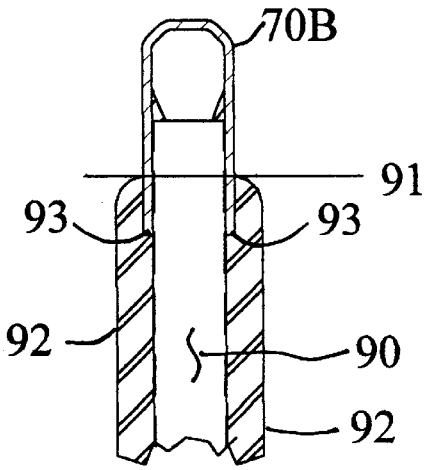
Figure 9C:
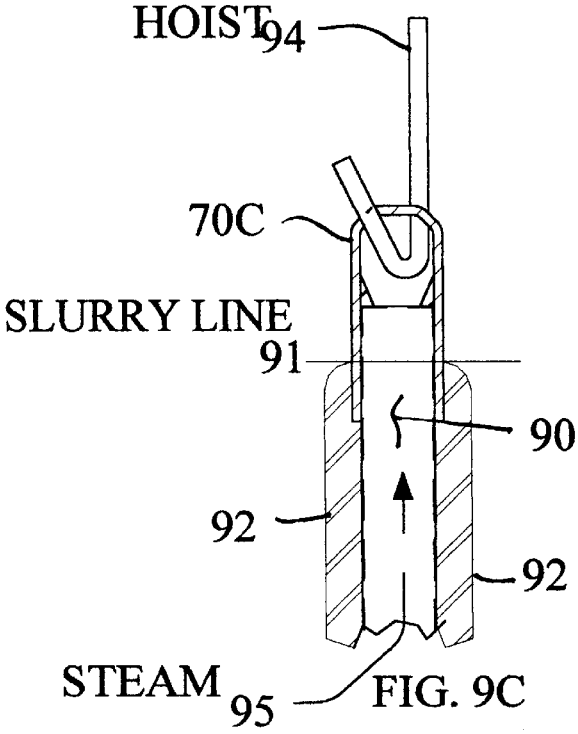

During the electro-deposition process, FIG. 9B, metal 92 is deposited onto the surface of cathode 90 as well as ends 93.

When the electro-deposition process is terminated, steam 95 is passed through the interior cavity of cathode 90. Steam

90 has sufficient temperature to boil slurry bath 91 and thereby force the deposited metal away from cathode 90.

Hoist 90 is secured to bracket 70C in preparation of the harvesting.

Figure 9D:
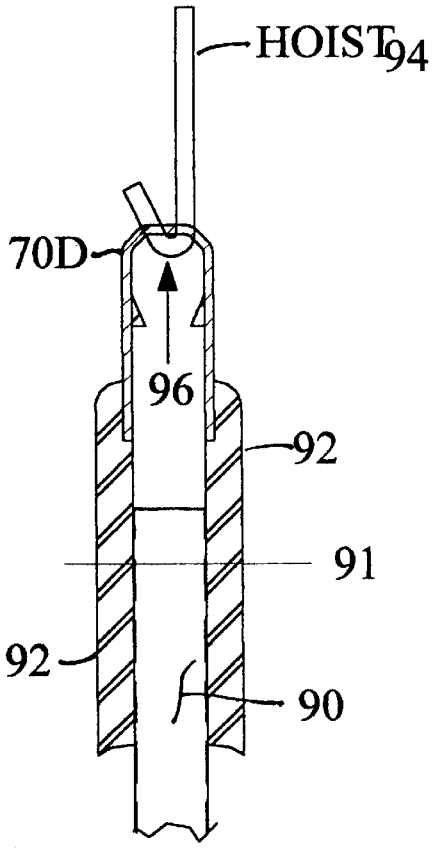

Once the deposited metal 92 has been severed from cathode 90, FIG. 9D, hoist 94 lifts bracket 70D with the attached deposited metal 92, from slurry bath 91.

The process is then repeated.

Note, cathode 90 is not disturbed during the entire process. Only the harvested deposited metal is removed from the slurry bath.

FIG. 10 is a top view which diagrams the preferred connection for the application of steam to the cathode as well as the preferred edge protector.

Cathode 90 is one of many cathodes within the electro-refining process. Anode 101A and 101B lie on each side of cathode 90 and facilitate the electro-deposition process. Bracket 70A has been placed over the top of cathode 90 as outlined above.

To prevent electro-deposition from occurring on edge 90A of cathode 90, edge 90A is nested into insulator 102 formed in the wall of slurry bath 91. Without the electrical flow, no deposition of metal will occur; hence end 90A is kept clean.

In this embodiment, the introduction of steam is from connector 103 which communicates with pipe 104 and eventually with the cavity within cathode 90 (not shown). Connector 103, in this embodiment is formed at the end of the support bracket for cathode 90.

FIGS. 11A and 11B are side views of the support mechanism and steam application system of one embodiment of the invention.

Steam is obtained from connector 111A and is controlled by valve 112 which, in this embodiment, is opened/closed manually. In another embodiment of the invention, valve 112 is electronically controlled and is opened/closed to maintain the desired temperature within cathode 90.

Steam travels through pipe 104A and into cavity 113 within cathode 90. The steam circulates through cavity 113 and exits through pipe 104B to connector 111B where it is either exhausted or is recycled for re-heating.

FIG. 12 is a frontal view of one embodiment of the cathode.

In this embodiment, cathode 120 is formed from two plates of metal which spot welded 121 and seam welded 125 to each other. These two types of welding are used to define a channel system within the cavity between the two plates for the steam to pass.

The introduction of steam into the cavity is accomplished using copper pipe 122 which is supported by a stainless steel bracket 123. This assembly (copper pipe 122 and bracket 123) is then covered by a fiberglass jacket 124 for insulation and safety.

It is clear that the present invention creates a highly improved electro-refining apparatus.

What is claimed is:

1. A method for electro-refining comprising the steps of:

a) while a hollow and generally planar cathode is in a mineral bath, placing a bracket over a top of said cathode such that ends of said bracket are proximate to surfaces of said cathode;

b) electro-depositing minerals onto said opposing sides of said cathode and said ends of said bracket by passing an electrical current flowing through said cathode;

c) grasping said bracket with a hoist;

d) dislodging deposited mineral from said cathode; and, e) hoisting said deposited mineral from said mineral bath.

2. The method for electro-refining according to claim 1, wherein the step of electro-depositing minerals includes the step of embedding the ends of said bracket into said deposited minerals.

3. The method for electro-refining according to claim 2, wherein the step of dislodging deposited mineral includes the steps of:

a) forming a heated medium; and, b) passing said heated medium through an interior cavity in said cathode.

4. The method for electro-refining according to claim 3, wherein the step of forming a heated medium includes the step of creating steam having a temperature in excess of a boiling point of said mineral bath.

5. The method for electro-refining according to claim 3, further including the step of, preventing minerals from being electro-deposited on edges of said generally planar cathode.

6. An electro-refining mechanism comprising:

a) a bath containing a solute of metal;

b) an electrically conductive bar positioned along an edge of said bath of solute;

c) at least two cathodes assemblies, each cathode assembly being adapted for immersion in said bath and including, 1) a support bracket supporting said cathode assembly such that a portion of the cathode assembly is immersed in said bath, said support bracket being in electrical contact with said electrically conductive bar, 2) a first plane member and a second plane member forming a hollow cavity therebetween, a portion of each plane member being immersed in said bath, and, 3) a bracket extending over a top of said first and second plane members such that a first end of said bracket extends into said bath of solute of metal near said first plane member, and a second end of said bracket extends into said bath of solute of metal near said second plane member;

d) means for selectively passing a super-heated medium through said hollow cavity of each cathode assembly to dislodge deposited minerals on said first plane member and said second plane member; and, e) means for removing dislodged deposited minerals from said bath of solute utilizing said bracket.

7. The electro-refining mechanism according to claim 6, wherein said support bracket further includes:

a) a first channel adapted to introduce said super-heated medium into said hollow cavity; and, b) a second channel adapted to exhaust said super-heated medium from said hollow cavity.

8. The electro-refining mechanism according to claim 7, wherein said super-heated medium includes steam.

9. The electro-refining mechanism according to claim 8, further including, for each cathode assembly:

a) a fuse block interposed between said support bracket and said electrically conductive bar, said fuse block supporting said cathode assembly and adapted to melt at a pre-selected electrical current flow; and, b) a catch bar being electrically isolated from said electrically conductive bar, said catch bar positioned to support said cathode assembly as said fuse block melts.

10. The electro-refining mechanism according to claim 8, wherein said bath includes, for each cathode assembly, an insulator engaging a periphery of said cathode assembly to prevent electro-depositing from occurring along said periphery of said cathode assembly.

11. The electro-refining mechanism according to claim 8, further including means for curtailing electrical current in said electrically conductive bar when said means for passing a super-heated medium is operational.

12. An electro-refining electrode comprising:

a) a first planar member.

b) a second planar member connected to said first planar member around a periphery of said first and second planar members, said first planar member and said second planar member forming an envelope therebetween:

c) a support bracket connected to an upper edge of said first planar member and said second planar member. said support bracket being in electrical communication with said first and second planar members; and d) channel means for introducing and exhausting super-heated medium into said envelope between said first and said second planar member, said channel means being incorporated into said support bracket; and a fuse block interposed between said support bracket and an electrically conductive bar, said fuse block, when in use, supporting a cathode and adapted to melt at a pre-selected current range.

13. The electro-refining electrode according to claim 12, wherein said first planar member and said second planar member have rare h s therein.

14. The electro-refining electrode according to claim 13, wherein said electrode is utilized as an anode.

* * * * *

UNITED STATES PATENT AND TRADEMARK OFFICE

CERTIFICATE OF CORRECTION

PATENT NO. : 6,245,209 B1
DATED : June 12, 2001
INVENTOR(S) : William A. Jacobs

It is certified that error appears in the above-identified patent and that said Letters Patent is hereby corrected as shown below:

Title page,
Inventor, replace "Jacobs Bill" with -- William A. Jacobs --.

Claim 13,
Line 3, replace "h s" with -- earth metals --.

Signed and Sealed this

Fifth Day of February, 2002

*Attest:*

*Attesting Officer*

JAMES E. ROGAN
*Director of the United States Patent and Trademark Office*